US008002670B2

(12) United States Patent
Kadota

(10) Patent No.: US 8,002,670 B2
(45) Date of Patent: Aug. 23, 2011

(54) RESISTANCE TRAINING DEVICE EXERTING A CONSTANT LOAD WITHOUT DEPENDING UPON POSITION

(75) Inventor: Kenji Kadota, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 11/878,709

(22) Filed: Jul. 26, 2007

(65) Prior Publication Data

US 2008/0026923 A1 Jan. 31, 2008

(30) Foreign Application Priority Data

Jul. 28, 2006 (JP) ..... 2006-205829

(51) Int. Cl.
*A63B 21/005* (2006.01)

(52) U.S. Cl. ..... 482/5; 482/1

(58) Field of Classification Search ..... 482/1–8, 482/66, 122, 51; 700/245; 602/16, 23; 434/247; 623/25; 318/568.12; 73/379.01
See application file for complete search history.

(56) References Cited

U.S. PATENT DOCUMENTS

| | | | | |
|---|---|---|---|---|
| D373,394 | S * | 9/1996 | Jacobs | D21/690 |
| 5,830,160 | A * | 11/1998 | Reinkensmeyer | 600/595 |
| 5,915,073 | A * | 6/1999 | Maeda | 700/245 |
| 6,992,456 | B2 * | 1/2006 | Furuta et al. | 318/568.12 |
| 7,153,242 | B2 * | 12/2006 | Goffer | 482/66 |
| 2003/0135303 | A1 * | 7/2003 | Arai et al. | 700/245 |
| 2004/0097330 | A1 * | 5/2004 | Edgerton et al. | 482/1 |
| 2006/0229170 | A1 * | 10/2006 | Ozawa et al. | 482/92 |
| 2007/0054777 | A1 * | 3/2007 | Kawai et al. | 482/1 |
| 2007/0191743 | A1 * | 8/2007 | McBean et al. | 601/5 |
| 2008/0161937 | A1 * | 7/2008 | Sankai | 623/25 |

FOREIGN PATENT DOCUMENTS

| | | |
|---|---|---|
| JP | 2000-210272 | 8/2000 |
| JP | 2001-204850 A | 7/2001 |
| JP | 2002-523182 A | 7/2002 |
| JP | 2003-220102 A | 8/2003 |
| JP | 2007-061137 | 3/2006 |
| JP | 2006-231454 | 9/2006 |

OTHER PUBLICATIONS

T. Fujikawa, et al., "Concerted activities of a group of mono-articular muscle and a group of bi-articular muscles in upper limbs, acting in antagonism to one another, and analysis of control functions thereof by a mechanical model," Biomechanisms, The Society of Biomechanisms, pp. 181-191, 1996.

* cited by examiner

*Primary Examiner* — Loan Thanh
*Assistant Examiner* — Shila Abyaneh
(74) *Attorney, Agent, or Firm* — Rabin & Berdo, P.C.

(57) ABSTRACT

A resistance training device effectively training the muscular force of a desired muscle includes a saddle for a user to sit on, a robot arm adjustable to the length of a limb of the user, a fastener for securing the robot arm to the limb, a controller for controlling the torque of a driving source driving a joint of the robot arm, and an input operating unit for the user to input a driving condition. When the user inputs a training load and an output direction of the distal end of the limb to be trained, the value of a torque necessary for generating the training load is calculated. The robot arm generates the torque of the calculated magnitude acting in a direction opposite to the output direction in such a manner that a constant training load is exerted to the user without dependency on the position of the user.

6 Claims, 8 Drawing Sheets

RESISTANCE TRAINING DEVICE EXERTING A CONSTANT LOAD WITHOUT DEPENDING UPON POSITION

BACKGROUND OF THE INVENTION

1. Field of the Invention

The present invention relates to a resistance training device.

2. Description of the Background Art

A resistance training device, exploiting a bi-articular link mechanism, such as a bi-articular arm device, has so far been proposed in, for example, Japanese patent laid-open publication No. 2007-061137. There has also been disclosed a technique which uses a pseudo-bicycle type resistance training device to vary a load depending on the angle of rotation for training a specified muscle.

The aforementioned conventional pseudo-bicycle type resistance training device is not high in efficiency because the load may remain applied to the target muscle only for shorter time. On another conventional type of resistance training device employing a weight, efficient training cannot be accomplished until the user has learned a correct training form. Moreover, in order to train the muscles on various sites of a body, it is necessary to use various kinds of resistance training devices appropriate therefor.

SUMMARY OF THE INVENTION

It is an object of the present invention to provide a resistance training device which is free from the above problems of the conventional resistance training device.

It is a more specific object of the present invention to provide a resistance training device which can perform resistance training effectively no matter what position is assumed by the user's limb.

In accordance with the present invention, the resistance training device includes a saddle for a user to sit on, and a robot arm adjustable to the length of a limb of the user. The robot arm is secured to the limb of the user and generates the force opposing to the force of the muscle to be trained in such a manner that a constant training load is exerted to the user without dependency on the position of the user.

More specifically in accordance with the present invention, there is provided a resistance training device including a saddle for a user to sit on, a robot arm adjustable to the length of a limb of the user, a fastener for securing the robot arm to the limb of the user, a controller for controlling the torque of a driving source for driving a joint of the robot arm, and an input operating unit for the user to input a driving condition. When the user inputs a training load and an output direction of a distal end of his or her limb to be trained, the value of a torque necessary for generating the training load is calculated. The robot arm generates the torque of the calculated magnitude acting in a direction opposite to the output direction in such a manner that a constant training load is exerted to the user without dependency on his or her position.

In an aspect of the present invention, the controller may be adapted to exercise control so that the distal end of the robot arm will exhibit elasticity, and so that, when the user enters an output direction of the distal end of his or her limb to be trained, elasticity in the output direction is set so as to be larger or smaller than elasticity in a direction substantially perpendicular to the output direction.

In another aspect of the present invention, the controller exercises control so that the distal end of the robot arm will exhibit elasticity, and is operative in response to the input operating unit receiving from the user as the driving condition an output direction of the distal end of his or her limb to be trained and a selection as to elasticity to set elasticity in the output direction so as to be smaller or larger than elasticity in a direction substantially perpendicular to the output direction.

In a further aspect of the present invention, the controller of the resistance training device sets, when the user inputs the output direction of the distal end of the user and a training load, the training load entered as an upper limit of the training load generated by the robot arm, and sets zero as a lower limit of the training load generated by the robot arm.

The resistance training device according to the present invention includes a saddle for a user to sit on and a bi-articular robot arm adjustable to the length of the user's limb. The robot arm is secured to the user's limb and adapted to generate the force acting in an opposite direction to the direction of the muscular force of a muscle desired to be trained. The muscular force for the desired muscle may be trained effectively without dependency on the position of the user's limb.

BRIEF DESCRIPTION OF THE DRAWINGS

The objects and features of the present invention will become more apparent from consideration of the following detailed description taken in conjunction with the accompanying drawings in which.

DESCRIPTION OF THE PREFERRED EMBODIMENTS

Now, with reference to the accompanying drawings, a preferred embodiment of a resistance training device according to the present invention will be described in detail. First, with reference to FIG. 3, a user 20 in the present embodiment uses a resistance training device 10 as later described for training his or her muscular force. Initially, by way of giving the background information on the resistance training device 10, the bi-articular link mechanism of the limb of a human body will now be described insofar as such description is necessary for understanding the present invention.

In a well-known manner, bi-articular muscles are present in the limbs, that is, four limbs, of the human being. The bi-articular muscles act in concert with the mono-articular muscles, operating on a sole joint, to control an output of a distal end, which output may be represented by hexagonally-shaped output distribution shown in FIG. 5, as disclosed for example in T. Fujikawa, et al., "Concerted activities of a group of mono-articular muscle and a group of bi-articular muscles in upper limbs, acting in antagonism to one another, and analysis of control functions thereof by a mechanical model", Biomechanisms, The Society of Biomechanisms, pp. 181-191, 1996, Tokyo. There is also known a method for evaluating the force of muscles based on functions, in accordance with hexagonally-shaped output distribution characteristics, as disclosed for example in Japanese patent laid-open publication No. 2000-210272.

Figure 3:
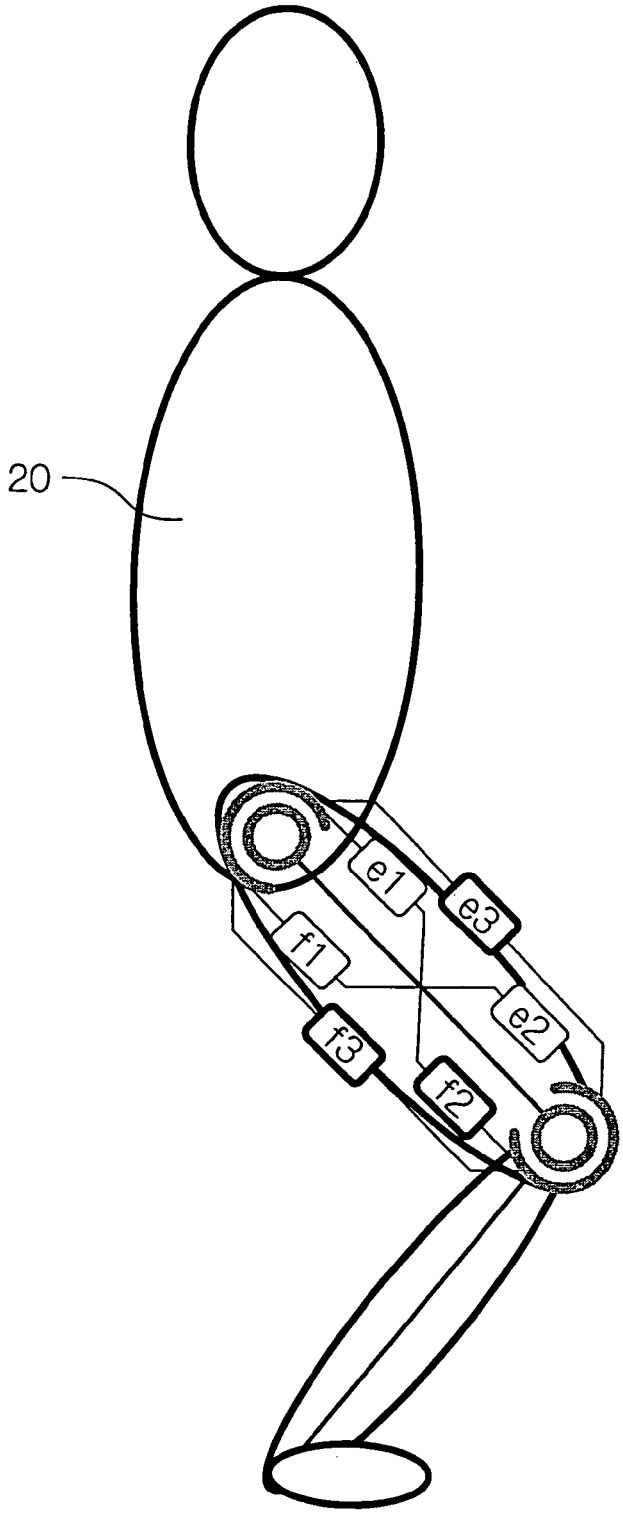
FIG. 3 schematically shows groups of muscles of a user's limb in the first embodiment of the present invention.

The output characteristics at the distal ends of the four limbs, disclosed in both of the prior art documents, will now be described insofar as such description is necessary for understanding the present invention. Each of the upper and lower limbs of a human body may be represented by three paired muscles, totaling at six muscles, in an exercise within a two-dimensional plane including a first joint, a second joint and a distal end of the pertinent system if the functions of the muscles are taken into account. As shown in FIG. 3, these muscles are an antagonistic mono-articular muscle pair (f1, e1) around the first joint, an antagonistic mono-articular muscle pair (f2, e2) around the second joint, and an antagonistic bi-articular muscle pair (f3, e3), lying astride the first and second joints. The muscles are termed function-based muscles of praxis. The muscles shown by way of an example in FIG. 3 are a group of muscles acting on a hip joint and a knee joint of the lower limb of the user 20.

The mono-articular muscle denotes a muscle acting only on a sole joint. The mono-articular muscle of the upper limb may be exemplified by the anterior part or the posterior part of a deltoid of a shoulder joint, brachial muscle of an elbow joint and the caput lateralis (outer head) of the triceps of the upper arm. The mono-articular muscle of the lower limb may be exemplified by musculus gluteus maximus, waist joint, caput breve (short head) of biceps of thigh and vastus lateralis of the knee joint. The bi-articular muscles denote muscles acting astride two joints. Specifically, the bi-articular muscles of the upper limb may be exemplified by the biceps of the upper arm and the caput longum (long head) of the triceps of the upper arm, while that of the lower limb may be exemplified by ham strings or the straight muscle of thigh.

Figure 4:
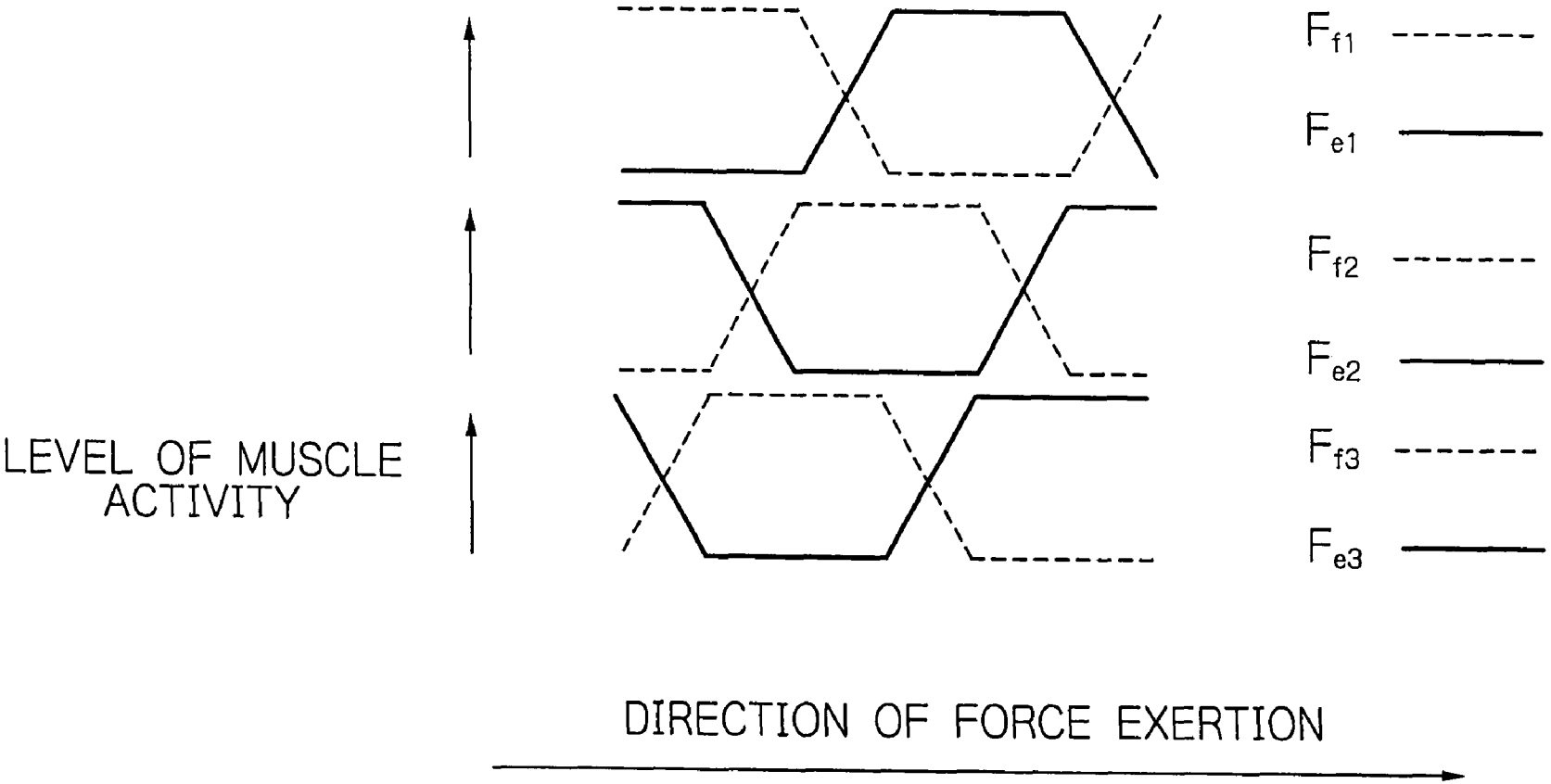
FIG. 4 schematically shows the degree or pattern of activities of the muscles of the user's limb in the first embodiment.

An output displayed at a distal end of a system of the bi-articular links of the upper and lower limbs of the human body, that is, at the joint of the wrist part of a hand for the upper limb and at the ankle joint for the lower limb, and the direction of the output, are controlled by concerted activities of the function-based muscles of praxis, namely the aforementioned three paired muscles, totaling at six muscles. If the force is exerted with the maximum effort in respective directions at the distal end of the system, the function-based muscles of praxis, namely the aforementioned three paired muscles, are alternately contracted, depending on the direction of force exertion, as shown in FIG. 4. In this figure, F denotes the magnitude of the force of the joint muscles indicated by the suffixes.

Figure 5:
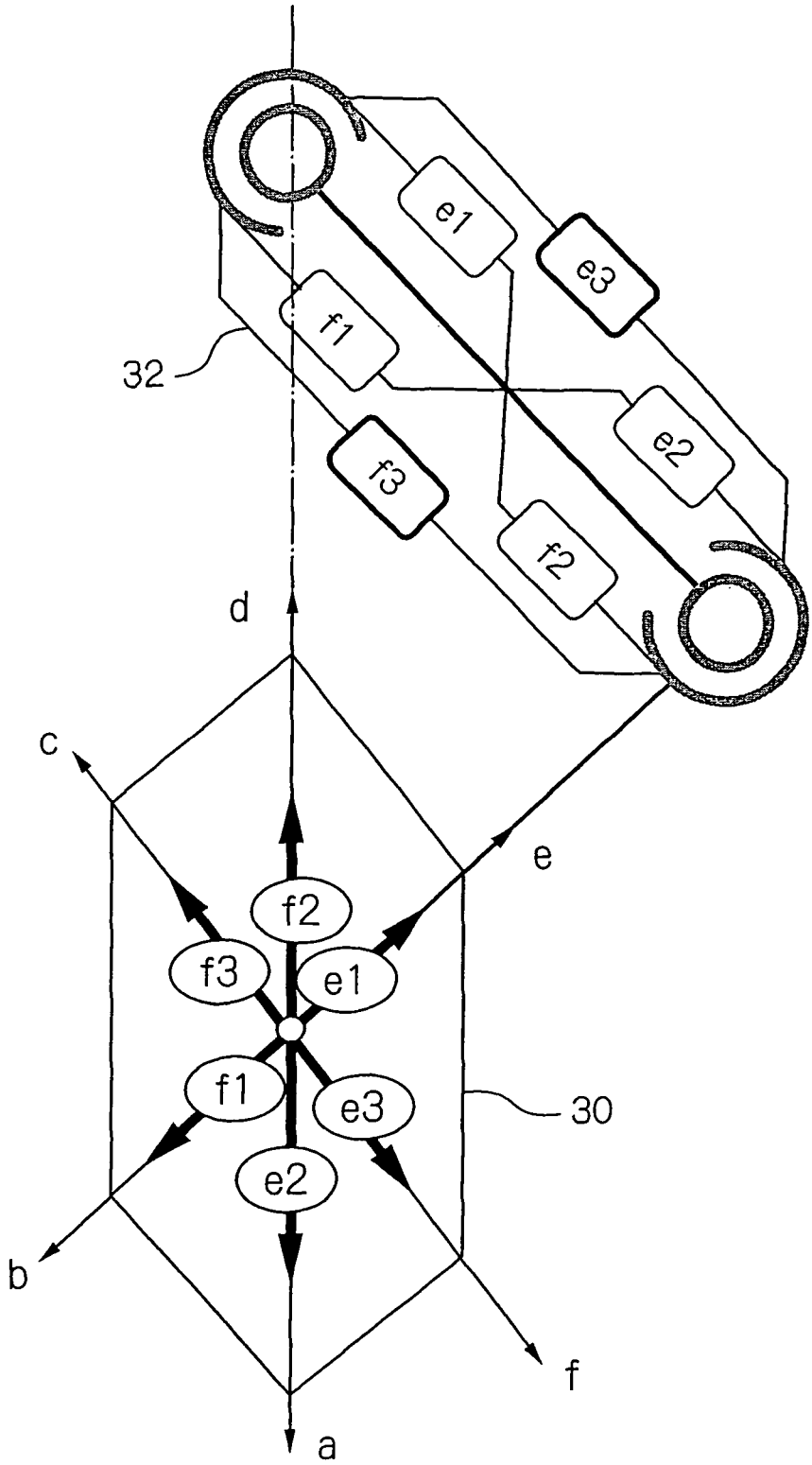
FIG. 5 schematically shows characteristics of the muscles of the user's limb in the first embodiment.

The directions of the force generated at the distal ends of the limb due to the contractile force displayed by the three paired function-based muscles of praxis at the distal end are indicted in FIG. 5. More specifically, hexagonally-shaped maximum output distribution characteristics are displayed by force synthesis under the concerted control in accordance with the alternating pattern shown in FIG. 4.

The sides of the hexagon of the maximum output distribution characteristics are parallel to the first and second links and a straight line interconnecting the first joint with the distal end of the system. Hence, the hexagonal shape differs with the positions of the limbs. Even though the contractile forces of the muscles remain constant so that the torque generated in each joint is not changed, the force generated at the distal end of the limb of the human body is changed in direction and magnitude, by the torques at the joints, depending on the positions of the upper or lower limb.

Figure 1:
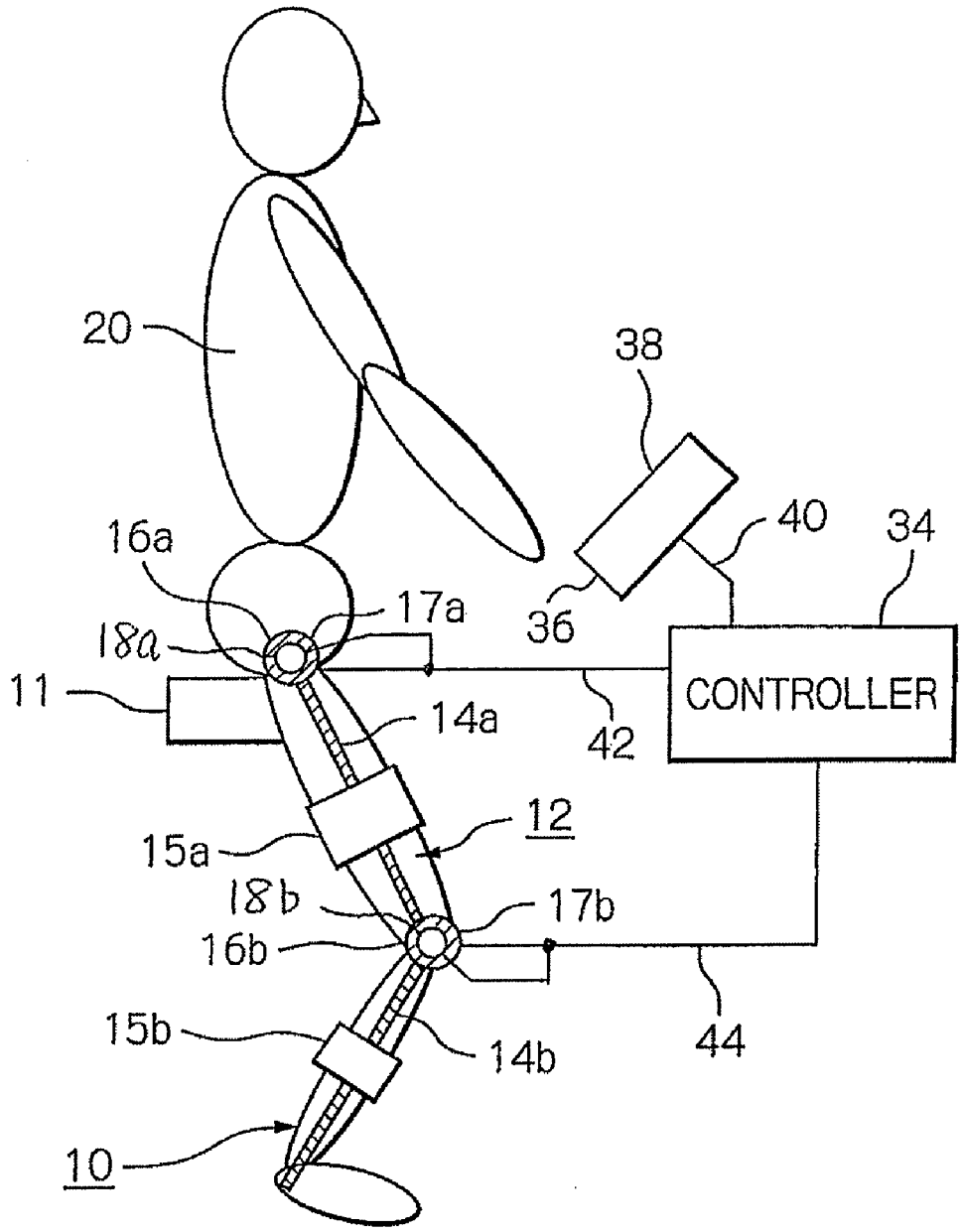
FIG. 1 is a side elevation schematically showing a use environment of a resistance training device in accordance with the present invention.
Figure 2:
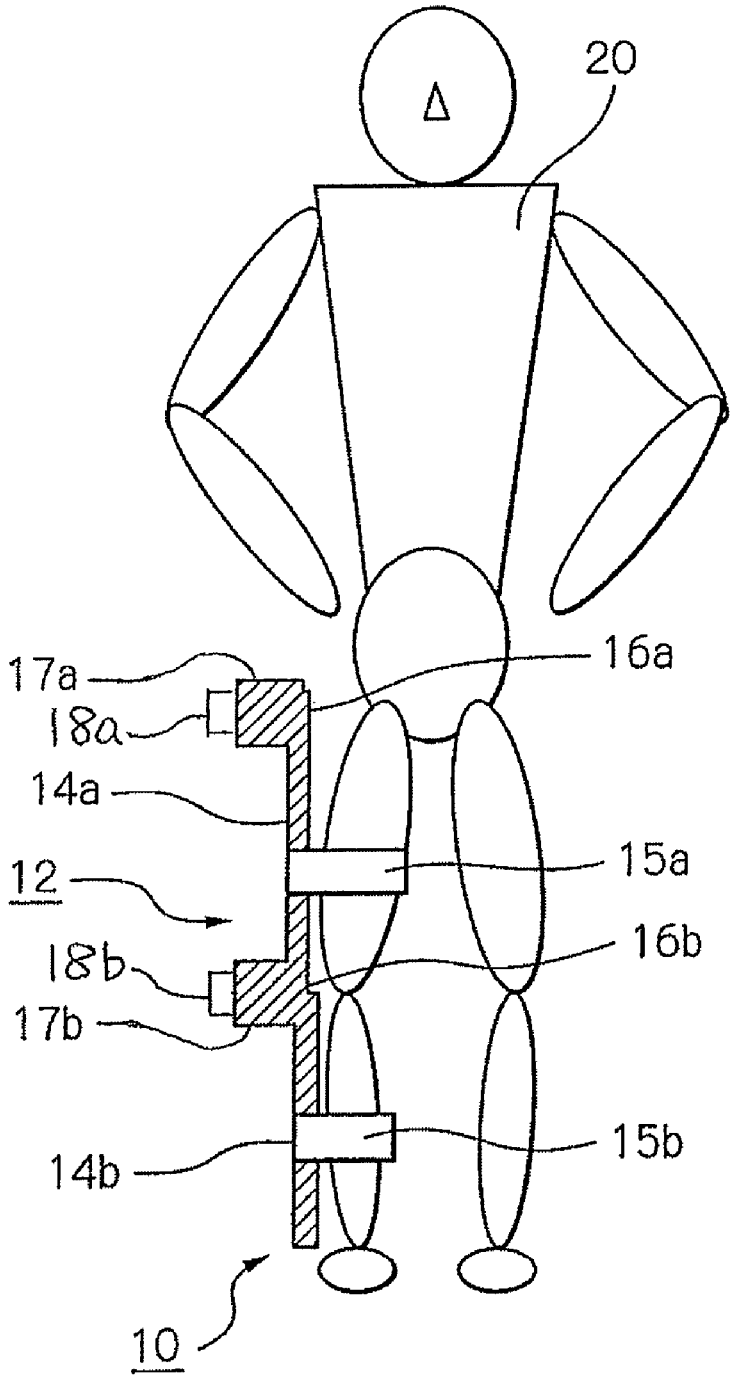
FIG. 2 is a front view schematically showing the use environment of the resistance training device shown in FIG. 1.

The constitution of the resistance training device 10 of the present embodiment will now be described. FIGS. 1 and 2 schematically show the constitution of the first, illustrative embodiment of the present invention. FIGS. 1 and 2 are a side view and a front view of the training device, respectively.

The resistance training device 10 of the instant embodiment provides for most effective training as the aforementioned output characteristics of the limb of the human being are taken into account. Referring to FIGS. 1 and 2, the resistance training device 10 is made up of a saddle 11, on which sits a user 20, a robot arm 12, a system controller 34 for controlling the robot arm 12, and an input operating unit 36 for allowing a user 20 to input his or her intention of the training of the muscular force. The input operating unit 36 is interconnected to the controller 34 as depicted by a connection 40. The input operating unit 36 may be equipped with a display unit 38, as will be described later on, for visualizing information to the user 20 under the control of the controller 34. The robot arm 12 is mounted for extending along the limb of the user 20. Although the lower limb is taken here for description, the same may apply for the upper limb as well.

The robot arm 12 is made up of two links, that is, a first link 14*a* for a thigh and a second link 14*b* for a lower leg, and hence is of two degrees of freedom. The first link 14*a* and the second link 14*b* are each provided with a slide mechanism for adjusting the link length. For resistance training, the first and second links are adjusted so as to be almost or substantially equal in length to the thigh and the foot of the user 20, respectively, and are fastened to the thigh and the leg using a first fastener 15*a* and a second fastener 15*b*, respectively. The first link 14*a* and the second link 14*b* may sometimes be referred collectively to as a link 14. The first fastener 15*a* and the second fastener 15*b* may also sometimes be referred collectively to as a fastener 15.

The robot arm 12 is worn by the user 20 when he or she is seated on the saddle 11. At this time, the first joint axle 16*a* of the robot arm 12 is brought into register with the hip joint of the user 20, and the second joint axle 16*b* of the robot arm 12 is brought into register with his or her knee joint. To the first joint axle 16*a* and the second joint axle 16*b* are connected a first servo motor 17*a* and a second servo motor 17*b*, respectively, which are driven under the control of the controller 34 as depicted with connections 42 and 44. The first joint axle 16*a* and the second joint axle 16*b* may sometimes be referred to collectively as a joint axle 16. The first servo motor 17*a* and the second servo motor 17*b* may also sometimes be referred to collectively as a servo motor 17. The servo motor 17 operates as a driving source for the joint and generates a torque for rotating the joint axle. The torque generated by the servo motor 17 is controlled by the controller 34.

The operation of the resistance training device 10 having the above-described constitution will now be described in detail. Initially, the user 20 operates the input operating device 36 for the resistance training device 10, to input a training menu or schedule. The training menu is input as the user enters the output direction in which lies the distal end of the limb the user wants to train, and the magnitude of the training load, based on the hexagonal shape of distribution characteristics of the maximum output indicated for example in FIG. 5.

For example, it is supposed that the user 20 intends to increase the jump distance of a standing broad jump, and hence to augment the output at the distal end in a direction b in lower one 30 of the hexagons shown in FIG. 5. The user 20 then selects the direction b as the output direction for training, while inputting the magnitude of the training load. It is seen from the alternation pattern of the three paired muscles, shown in FIG. 4, that the muscles that are in operation when the user exerts the force in the direction b are f1 (group of hip joint mono-articular flexers), e2 (group of knee joint mono-articular flexers) and f3 (group of bi-articular flexers for thigh).

For augmenting the output in the direction b, it is sufficient to train the group of three muscles, that is, f1, e2 and f3. Hence, in the resistance training device 10, the torques generated when the above group of three muscles is in operation, by the first servo motor 17*a* and the second servo motor 17*b*, associated with the hip joint and the knee joint, respectively, are increased in the opposing direction, either progressively or stepwise, up to the magnitude of the training load as entered by the user 20. The user then exerts the force to oppose to the torques generated by the resistance training device 10 to maintain the state of the preset muscle output to train his or her muscular force.

Since the resistance training device 10 exerts a constant torque as a load to the user 20, he or she may perform the isometric training provided that he or she makes an endeavor not to change the position of the distal end of his or her limb (ankle in the above example). Moreover, since the load applied to the muscle is not changed even if the position of the user 20 is changed during training, the user may perform the isotonic training.

Thus, in the present illustrative embodiment, if the user 20 inputs the outputting direction for the distal end of the limb desired to be trained and the training load, then the magnitude of the torque necessary to generate the training load is calculated. The robot arm 12 then generates a torque having the so calculated magnitude and acting in the direction opposite to the output direction. Hence, a constant load may be applied to the user without dependency on the position of the user 20.

Thus, the user 20, employing the resistance training device 10, may perform, even when the user is unconscious of his or her form during training or no matter what position is assumed by the limb, highly effective training as the specified load is applied. Consequently, even when the user 20 is a beginner, he or she may perform the targeted training with ease. In addition, since the load may be applied only for the direction in which he or she desires to train his or her muscles, training may be carried out highly efficiently.

Meanwhile, from consideration of the relationship between the group of muscles of praxis and the output of the distal end of the limb, the following becomes clear. That is, in the hexagons 30 and 32 shown in FIG. 5, f1 (group of hip joint mono-articular flexers) is in operation when the force is generated in the directions a and c. However, e2 (group of knee joint mono-articular flexers) is not in operation in the direction c, while f3 (group of bi-articular flexers for thigh) is not in operation in the direction a. Hence, if the training in the direction a and that in the direction c are effected at a rate of 1:1, f (group of hip joint mono-articular flexers) is trained twice as much as e2 (group of knee joint mono-articular flexers) or f3 (group of bi-articular flexers for thigh), thus enabling selective training of f1 (group of hip joint mono-articular flexers).

Well, an alternative, second embodiment of the present invention will be described. The components which are the same as those of the first embodiment are depicted by the same reference numerals and a repetitive description therefor is dispensed with. The operation and the favorable effect which are the same as those of the first embodiment are also dispensed with from description.

In the present alternative embodiment, a multi-articular arm mechanism, taught by claim 6 of Japanese patent laid-open publication No. 2006-231454, which is a prior application and assigned to the same assignee as the present patent application, is used as the robot arm 12 of the resistance training device 10. A joint angular sensor 18*a* or 18*b*, FIGS. 1 and 2, made up of an absolute type encoder, is arranged at each joint, to make use of the multi-articular arm mechanism. The joint angular sensor 18*a* or 18*b* may be provided on the servo-motor 17 or may be arranged on the links 14. The display unit 38, FIG. 1, may also be provided to supply the user 20 with the information on the training load. The constitution of the remaining portions of the alternative embodiment may be the same as that of the first embodiment and hence the repetitive description is dispensed with.

Figure 6:
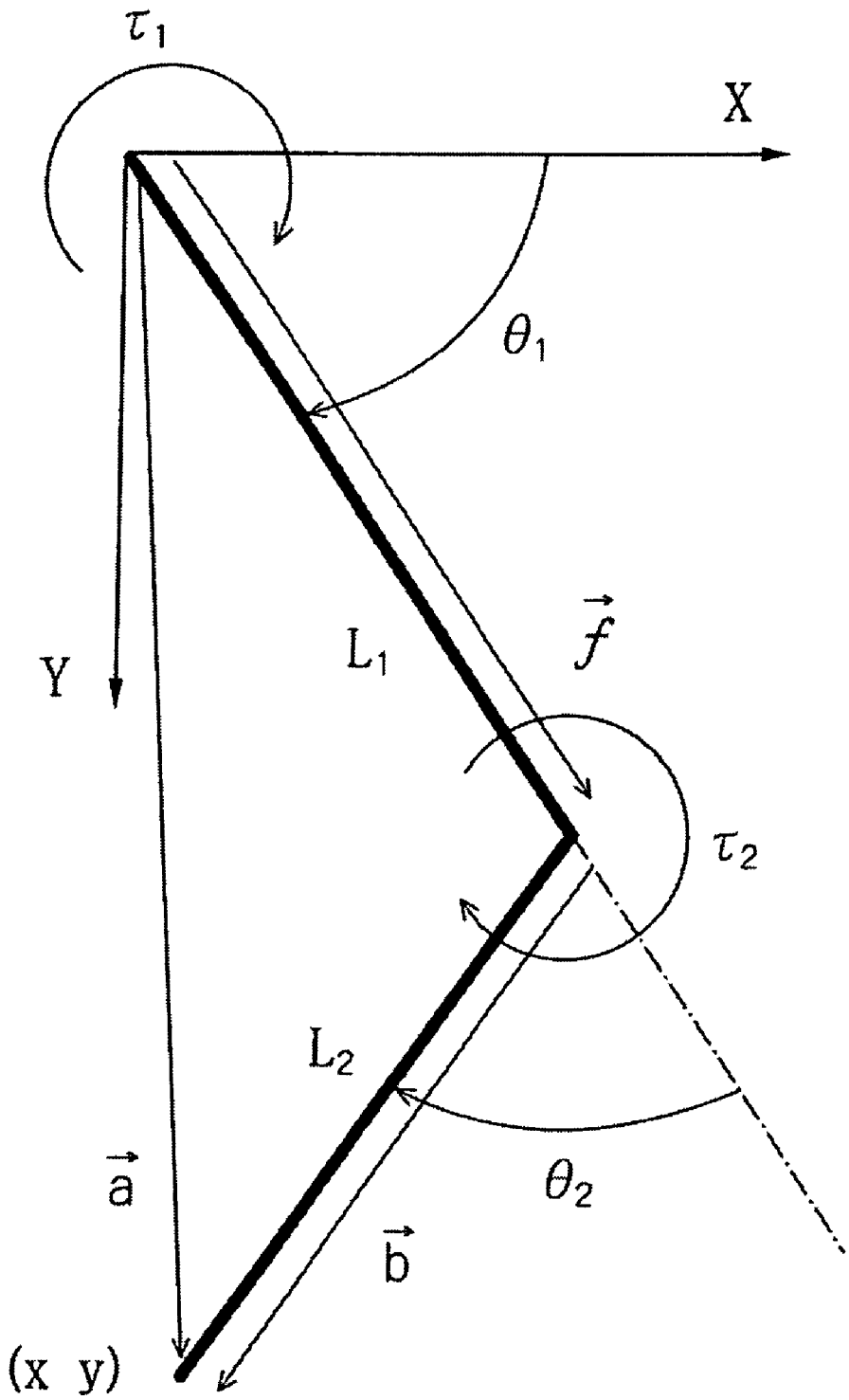
FIG. 6 is a chart useful for understanding how to align the load direction with the eigenvector of stiffness characteristics in a second embodiment of the present invention.

The operation of the resistance training device 10 in the alternative embodiment will now be described in detail. FIG. 6 schematically illustrates how to coincide the direction of the load with the eigenvector of stiffness characteristics in the instant alternative embodiment.

The multi-articular arm mechanism according to claim 6 of the above-mentioned Japanese '454 publication is controlled so that the torque generated by the actuator provided at each joint will be equal to a value calculated by the following expression (1), $$\begin{pmatrix} \tau_{\alpha 1} \\ \tau_{\alpha 2} \end{pmatrix} = \begin{pmatrix} \tau_{u1} \\ \tau_{u2} \end{pmatrix} - \begin{pmatrix} \kappa_{11} & \kappa_{12} \\ \kappa_{21} & \kappa_{22} \end{pmatrix} \begin{pmatrix} \delta_1 \\ \delta_2 \end{pmatrix} \tag{1}$$

based on joint angles as measured by a joint angle detection device 18*a* or 18*b* provided at each joint. In the expression, $\tau_{\alpha 1}$ and $\tau_{\alpha 2}$ denote the torques produced by respective actuators, such as motors 17*a* and 17*b*, $\tau_{u1}$ and $\tau_{u2}$ denote arbitrary articular axle torques, not dependent upon articular angles, $\delta_1$ and $\delta_2$ denote displacing angles from the respective articular angles, and $\kappa_{11}$ $\kappa_{12}$, $\kappa_{21}$ and $\kappa_{22}$ denote arbitrary elasticity parameters. This reproduces characteristics substantially equivalent to stiffness characteristics and output characteristics of four limbs of the human being as clarified by aforementioned T. Fujikawa, et al.

With the present alternative embodiment, in which the multi-articular arm mechanism according to claim 6 of the aforementioned Japanese '454 publication is used as the robot arm 12 of the resistance training device 10, it is possible to afford elliptical stiffness characteristics to the distal end of the robot arm 12.

With the above-described first embodiment, the user 20 effects training as he or she opposes to the torque generated by the resistance training device 10. With the present alternative embodiment, the aforementioned stiffness characteristics are exploited to indicate the force direction during training to guide the user to perform the training with a correct load.

The stiffness characteristics may be represented in the form of relationship of the joint torque with the angle of displacement by a matrix of the following expression (2), $$\begin{pmatrix} \kappa_{11} & \kappa_{12} \\ \kappa_{21} & \kappa_{22} \end{pmatrix} \tag{2}$$

and may be represented by an ellipsis in the case of a bi-articular link.

The long and short axes of an ellipsis are substantially coincident with the direction of the eigenvector of the matrix and perpendicular to each other. The modulus of elasticity along the long axis or the short axis of the ellipsis is coincident with the eigenvalue for the eigenvector. With the robot arm 12 of the resistance training device 10, the eigenvalue and the eigenvector may be set to optional values.

In this case, the load direction is determined by the training menu as entered by the user 20. Thus, the modulus of elasticity is set so that the modulus of elasticity in the direction of the load will be smaller than that in the direction perpendicular to the load. The controller 34 exercises control to generate the joint torque responsive to the displacement of the joint angle from outside based on the so set stiffness characteristics. If the user exerts the force to afford the angular displacement to the robot arm 12, then a load torque is generated by the robot arm 12 in dependence upon the angular displacement.

The direction in which the user 20 may desire to perform training is such a direction in which the modulus of elasticity is lower and displacement is more liable to occur than along any other direction. Hence, the user 20 is able to recognize the direction in which he or she is to exert the force as being a direction in which he or she may move his or her body limb more readily for training.

It will now be described how to make the load direction coincident with the eigenvector of the stiffness characteristics. Referring also to FIG. 6, a vector a, beginning at a hip joint and terminating at a foot joint, and a vector b, beginning at a knee joint and terminating at the foot joint, as the directions in a training work space, are represented as base vectors. The direction in the hexagon of FIG. 5, in which the force is to be exerted, is the direction defined by the following expression (3), $$\vec{p}_s = \alpha\vec{a} + \beta\vec{b} \tag{3}$$

If the Jacobian determinant at the distal end of the bi-articular arm mechanism is labeled J, the direction perpendicular to the direction $p_s$ may be represented by the following expression (4), $$\vec{q}_s \,//\, J\begin{pmatrix}\alpha\\ \beta\end{pmatrix} \tag{4}$$

Additionally, the following expression (5) is valid, $$KP = K(\vec{p}_s \;\; \vec{q}_s) = (K\vec{p}_s \;\; K\vec{q}_s) = p\begin{pmatrix}\lambda_1 & 0\\ 0 & \lambda_2\end{pmatrix} \tag{5}$$

where λ1 and λ2 denote the modulus of elasticity in a direction $\vec{P}_s$ and that in a direction $\vec{q}_s$, respectively.

The relationship between the joint torque and displacement of the distal end of the bi-articular arm mechanism may be represented by the following expression (6), $$K = P\begin{pmatrix}\lambda_1 & 0\\ 0 & \lambda_2\end{pmatrix}P^{-1} \tag{6}$$

If the above relationship is rewritten into the relationship between the joint torque and the displacement of the joint angle, with the use of the relationship between the displacement of the distal end of the bi-articular arm mechanism and the displacement of the joint angle, then the following expression (7) will be obtained, $$G = \begin{pmatrix}g_{11} & g_{12}\\ g_{21} & g_{22}\end{pmatrix} = J^T P\begin{pmatrix}\lambda_1 & 0\\ 0 & \lambda_2\end{pmatrix}P^{-1}J \tag{7}$$

Since J is the Jacobian determinant, the above relationship is the function of the joint angle. Hence, in order to find the elements of the matrix J, actual joint angles are measured by joint angle detection units 18*a* and 18*b*, FIGS. 1 and 2, provided at the joints of the robot arm 12.

By the above expressions, the joint torques to be generated by the robot arm 12 when the robot arm 12 is displaced from the reference point are then calculated. The controller 34 then controls the joint torque of the robot arm 12, with the so calculated joint torque as target value, to arrive at desired stiffness characteristics. As in the above-described first embodiment, if the load direction for training a specified group of muscles is expressed by a linear combination having the vector a and the vector b as base vectors, the coefficients are constant. It is therefore sufficient to calculate a and B from the direction of the training load and to set λ1 so as to be smaller than λ2.

In the resistance training device 10 of the instant alternative embodiment, the training load is substantially equivalent to the force exerted by the user 20. Hence, the magnitude of the training load is displayed for the user on the display unit 38, FIG. 1, of the training device 10, while it is also displayed on the display unit 38 whether or not the training load has reached the value entered by the user 20 at the outset.

Thus, in the present alternative embodiment, the controller 34 exercises control so that the distal end of the robot arm 12 will exhibit elasticity. When the user 20 enters the output direction at the distal end of the limb to be trained, the controller 34 sets the elasticity in the output direction so as to be smaller than the elasticity in a direction substantially perpendicular to the output direction. More specifically, the robot arm 12 is designed to generate a load in response to an angular displacement which has been entered by the user 20. Since the user feels that a counter load is light in the direction of the training load, he or she is naturally guided to the correct training load exerting direction without extraneous feeling. If the user 20 does not effect training movements positively, no training load is generated, so that he or she may effect training in safety.

Another alternative, third embodiment of the present invention will now be described. The parts or components like in constitution the first and second embodiments are designated by the same reference numerals and the repetitive description is dispensed with. The description of the operation and the favorable effect which are the same as those of the above-described first and second embodiments is also dispensed with from description.

The constitution of the resistance training device 10 of the third embodiment is the same as that of the above-described second embodiment. Hence, the constitution will not be described again but only the operation thereof will be described.

Similarly to the above-described second embodiment, the present third embodiment guides the user 20 as to the direction of force exertion based on the stiffness characteristics. However, in distinction from the second embodiment, the modulus of elasticity is made higher in the direction in which the user 20 exerts his or her force in training, while the modulus of elasticity λ2 in a direction substantially perpendicular to the direction of force exertion in training is set approximately to zero. The remaining portions of the present embodiment may be the same as the above-described second embodiment and hence the corresponding description is dispensed with.

Thus, in the present alternative embodiment, the controller 34 exercises control in such a manner that the distal end of the robot arm 12 will exhibit elasticity. When the user 20 enters the output direction at the distal end of the limb to be trained, the controller 34 sets the elasticity in the output direction so as to be larger than the elasticity in a direction substantially perpendicular to the output direction. That is, the modulus of elasticity is raised for the direction in which the user exerts the force for training, while the modulus of elasticity λ2 for a direction substantially perpendicular to the direction of the force exertion is set to approximately zero.

Hence, the present alternative embodiment is specifically effective for a case where it is not possible with the second embodiment to properly guide the direction of the training load. Since the load is hardly generated for the direction substantially perpendicular to the direction of the force exertion, the load may be applied at least only in the desired training direction. Moreover, if the user 20 does not effect training movements positively, no training load is generated, as in the above-described second embodiment, so that he or she may perform the training in safety.

A still other alternative, fourth embodiment of the present invention will now be described. The parts or components having the same constitution as that in the first, second and third embodiments are designated with the same reference numerals and the repetitive description is dispensed with. The repetitive description of the operation and the favorable effect is also dispensed with which are the same as those of the above-described first, second and third embodiments.

The constitution of the resistance training device 10 of the fourth embodiment is the same as that of the above-described second embodiment, and hence is not described but only the operation thereof will be described.

In the present alternative embodiment of the resistance training device 10, the user may select and enter either the load direction guide means of the second or third embodiment, for training, by way of changing the operating mode. Which of the load direction guide means of the second or third embodiment is more suitable differs from one user 20 to another. Thus, in the present embodiment, the user 20 desirous to enter the load direction selects the guide method to switch between the operations of the resistance training device 10. Hence, the user 20 may perform effective training by a way he or she may feel more desirable.

A still further alternative, fifth embodiment of the present invention will now be described. The parts or components having the same constitution as that in the first to fourth embodiments are designated with the same reference numerals and the repetitive description thereon is dispensed with. The repetitive description of the operation and the favorable effect which are the same as those of the above-described first to fourth embodiments is also dispensed with.

Figure 7:
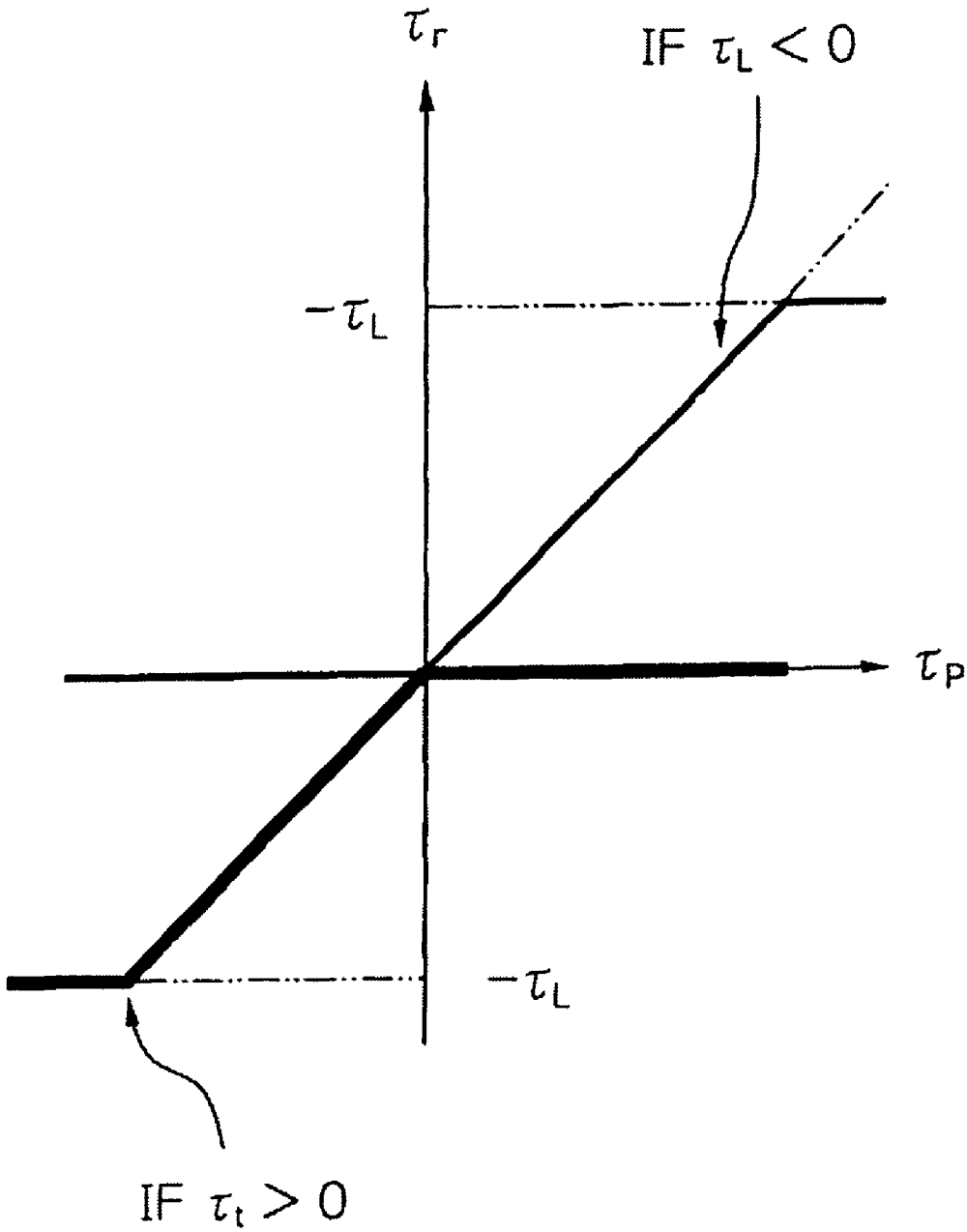
FIG. 7 plots saturation characteristics of a torque generated by a robot arm in a fifth embodiment of the present invention.
Figure 8:
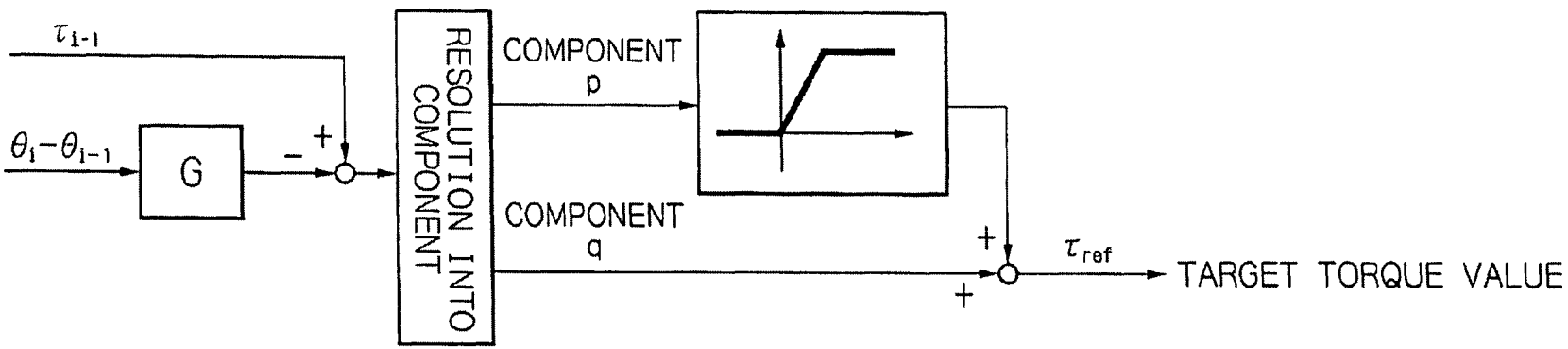
FIG. 8 is a schematic block diagram useful for understanding how to calculate the torque generated by a robot arm in the fifth embodiment of the present invention.

FIG. 7 shows saturation characteristics of torques generated by the robot arm of the fifth embodiment. FIG. 8 schematically shows a method for calculating the torque generated by the robot arm in the fifth embodiment.

The present fifth embodiment of the resistance training device 10 is similar in constitution to the above-described second embodiment. Hence, the repetitive description of the constitution is dispensed with, and only the operation will be described. It is noted that a display unit 38, FIG. 1, may be omitted.

The fifth embodiment of the resistance training device 10 exercises such a control as to guide the training load as in the way of the second or third embodiment earlier described so that the training load will get to the upper limit of the magnitude of the training load entered by the user.

The method for controlling the training load will now be described in detail. The matrix expressing the stiffness characteristics for guiding the training load depends upon not only the modulus of elasticity but also the joint angles. Since the relationship between the joint torque and the joint angle is non-linear, the target value of the joint torque is calculated by using the difference from one control period to another as represented by the following expression (8), $$\tau_t = \tau_{t-1} - G(\theta)\Delta\theta \tag{8}$$

where $t_t$ is a joint torque at time t and $t_{t-1}$, is a joint torque at time one control period before time t, while G(θ) is a matrix expressing stiffness characteristics for guiding the training load for the user 20, and is a function of the joint angle. Δθ is an angle by which the joint angle has changed as from time t−1 until time t.

As in the second or third embodiment, the present, fifth embodiment generates no training load unless the user 20 positively displaces the robot arm 12. In the fifth embodiment, however, the maximum value of the force in the force exerting direction desired by the user 20 is saturated to the magnitude of the load entered by the user 20. To this end, the load torque applied to the user 20 at time t is dissolved into a component of force $t_p$ of the desired training direction and a component $t_q$ perpendicular to $t_p$. The load torque may be dissolved in accordance with an expression exemplified by the following expression (9), $$\frac{(\tau_1\vec{b} - \tau_2\vec{a})\cdot(\tau_{1L}\vec{b} - \tau_{2L}\vec{a})}{\left|\tau_{1L}\vec{b} - \tau_{2L}\vec{a}\right|^2}\begin{pmatrix}\tau_{1L}\\ \tau_{2L}\end{pmatrix} \tag{9}$$

where $t_1$ and $t_2$ are torques at the hip joint and at the knee joint, respectively, and a suffix L denotes a torque which generates the magnitude of the load under which the user 20 desires to perform his or her training.

The force component $t_p$ is saturated with a torque $t_L$ which generates the magnitude of the load under which the user 20 desires to perform his or her training. Meanwhile, the torque generated by the robot arm 12 has saturation characteristics shown in FIG. 7. The torque to be generated by the robot arm 12 is the sum of $t_r$ and $t_q$ where $t_r$ is $t_p$ saturated with the torque $t_L$. Meanwhile, the torque to be generated by the robot arm 12 may be calculated by the scheme shown in FIG. 8.

Thus, as in the second and third embodiments, described above, the robot arm 12 of the fifth embodiment guides the training load for the user 20, while the robot arm 12 does not exert the load of a magnitude exceeding that entered by the user 20 in the training load exerting direction.

In this state, if the user 20 exerts a force further, the robot arm 12 is displaced, without the load being changed. The user 20 may then comprehend that the load he or she has entered has now been reached. At the same time, the user 20 may perform the training under a constant load within a range of displacement of the robot arm by the user.

If the lower limit value is set to zero in order not to apply force in a direction opposite to the load exerting direction, the user 20 may revert to a training start position under an unloaded state. In this manner, the user 20 may efficiently perform training repeatedly under a constant load with the direction and the magnitude of the load he or she has entered.

In this manner, in the present embodiment, training may be carried out under a constant state of the load applied to the user 20, while guiding the training load as in the second or third embodiment. As long as the user 20 exerts the force during the training, the load keeps on to be applied in the direction with the magnitude of the load entered by the user 20, thus assuring efficient training.

The entire disclosure of Japanese patent application No. 2006-205829 filed on Jul. 28, 2006, including the specification, claims, accompanying drawings and abstract of the disclosure is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

What is claimed is:

1. A resistance training device comprising:

a seat on which a user sits;

a robot arm adjustable to a length of a limb of the user and having a first link connected to a first joint axle at a first location corresponding to a first joint of the user and connected to a second joint axle at a second location, different from the first location, corresponding to a second joint of the user, a second link connected to the first link at the second joint axle, and a first driving source and a second driving source respectively connected to the first joint axle and the second joint axle for respectively rotating the first and second links about the first and second joint axles;

at least one fastener for securing said robot arm to the limb of the user;

joint angle sensors for sensing respective joint angles of said first and second joint axles;

an input operating unit for allowing the user to input a driving condition; and a controller for controlling a torque of the first and second driving sources for driving at least one of said first and second joint axles of said robot arm, said controller exercising control so that a distal end of said robot arm exhibits elasticity, wherein said controller is operative, in response to said input operating unit receiving from the user an output direction of a distal end of the limb to be trained as the driving condition to use a first vector beginning at the first joint axle of the robot arm and terminating at the distal end of the robot arm to represent a first load direction and a second vector beginning at the second joint axle of the robot arm and terminating at the distal end of the robot arm to represent a second load direction to calculate elasticity of the robot arm in an output direction based on the output direction received from the user, the elasticity being different between the output direction received from the user and a direction substantially perpendicular to the output direction received from the user, wherein said controller is thereafter operative in response to displacements $\delta_1$ and $\delta_2$ of the joint angles from arbitrary articular axle torques $\tau_{u1}$ and $\tau_{u2}$ to calculate values of torques $\tau_{\alpha1}$ and $\tau_{\alpha2}$ by means of expression (1) below, the displacements being caused when the user applies force to the robot arm in the load direction and being measured by said joint angle sensors, wherein said controller controls said first and second driving sources so that the torques generated by said first and second driving sources are substantially equal to the values calculated, $$\begin{pmatrix} \tau_{\alpha1} \\ \tau_{\alpha2} \end{pmatrix} = \begin{pmatrix} \tau_{\mu1} \\ \tau_{\mu2} \end{pmatrix} - \begin{pmatrix} \kappa_{11} & \kappa_{12} \\ \kappa_{21} & \kappa_{22} \end{pmatrix} \begin{pmatrix} \partial_1 \\ \partial_2 \end{pmatrix} \quad (1)$$

where $\kappa_{11}$, $\kappa_{12}$, $\kappa_{21}$ and $\kappa_{22}$ denote arbitrary elasticity parameters and where a training load input by the user and applied by the robot arm to the limb of the user is substantially equal to and opposed to the force applied by the user, the training load being opposite in direction to the output direction received from the user, wherein said controller sets, when the user inputs the output direction of the distal end of the limb to be trained and the training load, the training load input by the user as an upper limit of the training load generated by said robot arm, and sets zero as a lower limit of the training load generated by said robot arm, and wherein said robot arm is displaced when the user exerts a force exceeding the upper limit.

2. The device in accordance with claim 1, wherein the value set by said controller is smaller than the elasticity in the direction substantially perpendicular to the output direction.

3. The device in accordance with claim 1, wherein the value set by said controller is larger than the elasticity in the direction substantially perpendicular to the output direction.

4. A resistance training device comprising:

a seat on which a user sits;

a robot arm adjustable to a length of a limb of the user and having a first link connected to a first joint axle at a first location corresponding to a first joint of the user and connected to a second joint axle at a second location, different from the first location, corresponding to a second joint of the user, a second link connected to the first link at the second joint axle, and a first driving source and a second driving source connected to the first joint axle and the second joint axle for respectively rotating the first and second links about the first and second joint axles;

at least one fastener for securing said robot arm to the limb of the user;

joint angle sensors for sensing respective joint angles of said first and second joint axles;

an input operating unit for allowing the user to input a driving condition; and a controller for controlling a torque of the first and second driving sources for driving at least one of said first and second joint axles of said robot arm, said controller exercising control so that a distal end of said robot arm exhibits elasticity, wherein said controller is operative, in response to said input operating unit receiving from the user an output direction of a distal end of the limb to be trained as the driving condition and a selection of elasticity, to use a first vector beginning at the first joint axle of the robot arm and terminating at the distal end of the robot arm to represent a first load direction and a second vector beginning at the second joint axle of the robot arm and terminating at the distal end of the robot arm to represent a second load direction to calculate elasticity of the robot arm in an output direction based on the output direction received from the user, the calculated elasticity being different between the output direction received from the user and a direction substantially perpendicular to the output direction received in compliance with the selection of the user, wherein said controller is thereafter operative in response to displacements $\delta_1$ and $\delta_2$ of joint angles from arbitrary articular axle torques $\tau_{u1}$ and $\tau_{u2}$ to calculate values of torques $\tau_{\alpha 1}$ and $\tau_{\alpha 2}$ by means of expression (1) below, the displacements being caused when the user applies force to the robot arm in the load direction and being measured by said joint angle sensors, wherein said controller controls said first and second driving sources so that the torques generated by said first and second driving sources are substantially equal to the values calculated, $$\begin{pmatrix} \tau_{a1} \\ \tau_{a2} \end{pmatrix} = \begin{pmatrix} \tau_{\mu 1} \\ \tau_{\mu 2} \end{pmatrix} - \begin{pmatrix} \kappa_{11} & \kappa_{12} \\ \kappa_{21} & \kappa_{22} \end{pmatrix} \begin{pmatrix} \partial_1 \\ \partial_2 \end{pmatrix} \quad (1)$$

where $\kappa_{11}$, $\kappa_{12}$, $\kappa_{21}$ and $\kappa_{22}$ denote arbitrary elasticity parameters and where a training load input by the user and applied by the robot arm to the limb of the user is substantially equal to and opposed to the force applied by the user, the training load being opposite in direction to the output direction received from the user, wherein said controller sets, when the user inputs the output direction of the distal end of the limb to be trained and the training load, the training load input by the user as an upper limit of the training load generated by said robot arm, and sets zero as a lower limit of the training load generated by said robot arm, and wherein said robot arm is displaced when the user exerts a force exceeding the upper limit.

5. The device in accordance with claim 4, wherein the value set by said controller is smaller than the elasticity in the direction substantially perpendicular to the output direction.

6. The device in accordance with claim 4, wherein the value set by said controller is larger than the elasticity in the direction substantially perpendicular to the output direction.

* * * * *